United States Patent [19]

Biddle et al.

[11] Patent Number: 4,919,737

[45] Date of Patent: Apr. 24, 1990

[54] THERMOPLASTIC ELASTOMER-BASED LOW VULNERABILITY AMMUNITION GUN PROPELLANTS

[75] Inventors: Richard A. Biddle, Elkton, Md.; Rodney L. Willer, Newark, Del.

[73] Assignee: Morton Thiokol Inc., Chicago, Ill.

[21] Appl. No.: 294,321

[22] Filed: Jan. 6, 1989

Related U.S. Application Data

[63] Continuation-in-part of Ser. No. 229,032, Aug. 5, 1988.

[51] Int. Cl.[5] ..... C06B 45/50

[52] U.S. Cl. ..... 149/19.5; 149/19.6; 149/92

[58] Field of Search ..... 149/19.4, 19.5, 19.6, 149/92

[56] References Cited

U.S. PATENT DOCUMENTS

| | | | |
|---|---|---|---|
| 3,898,112 | 8/1975 | Strecker et al. | 149/19.9 |
| 4,091,729 | 5/1978 | Bell et al. | 149/19.4 |
| 4,393,199 | 7/1983 | Manser | 149/19.6 |
| 4,414,384 | 11/1983 | Berkowitz et al. | 149/19.6 |
| 4,456,493 | 6/1984 | Barnes et al. | 149/19.4 |
| 4,483,978 | 11/1984 | Manser | 149/19.6 |
| 4,597,924 | 7/1986 | Allen et al. | 149/19.4 |
| 4,689,097 | 8/1987 | Jones | 149/21 |
| 4,726,919 | 2/1988 | Kivostofferson et al. | 149/19.4 |
| 4,764,316 | 8/1988 | Brown et al. | 264/3.1 |
| 4,764,586 | 8/1988 | Manser et al. | 149/19.4 |
| 4,799,980 | 1/1989 | Reed | 149/19.4 |
| 4,804,424 | 2/1989 | Hinshaw | 149/19.6 |
| 4,806,613 | 2/1989 | Wardle | 528/59 |
| 4,808,689 | 2/1989 | Katz | 528/48 |

*Primary Examiner*—Edward A. Miller

*Attorney, Agent, or Firm*—Wayne E. Nacker; Gerald K. White

[57] ABSTRACT

LOVA gun propellants are formed from a thermoplastic elastomer and particulates of high-energy oxidizers, e.g., RDX and HMX.

9 Claims, No Drawings

THERMOPLASTIC ELASTOMER-BASED LOW VULNERABILITY AMMUNITION GUN PROPELLANTS

The Government has rights in this invention pursuant to Contract No. DAAA15-85-C-0037 awarded by the U.S. Army Armament, Munitions and Chemical Command. The invention described herein may be manufactured, used, and licensed by or for the Government for governmental purposes without the payment to us of any royalty thereon.

This application is a continuation-in-part of U.S. patent application Ser. No. 07/229,032 filed Aug. 5, 1988.

The present invention is directed to low vulnerability ammunition (LOVA) gun propellants in which the binder is a thermoplastic elastomer.

BACKGROUND OF THE INVENTION

A continuing objective in the design of gun propellants is to provide a gun propellant which is energetic when deliberately ignited, but which exhibits high resistance to accidental ignition from heat, flame, impact, friction, and chemical action. Propellants possessing such resistance to accidental ignition are known as "low vulnerability ammunition" (LOVA) gun propellants.

Conventional LOVA gun propellants comprise an elastomeric binder, throughout which are dispersed particulates of high-energy material, particularly oxidizers. The elastomeric binder is generally a cured elastomer, formed, for example, by the urethane reaction of a multi-functional prepolymer with a multifunctional isocyanate. Examples of such LOVA gun propellants are described, for example, in U.S. Pat. Nos. 4,263,070 and 4,456,493, the teachings of which are incorporated herein by reference. Generally, LOVA propellant grains are formed by extrusion at elevated temperatures whereat substantial curing takes place. Because the grains cure to some extent as they are being formed, control of extrusion conditions is difficult. If cured LOVA propellant is unused, it cannot be recycled, and burning the propellant is generally the only suitable disposal method.

Another type of LOVA propellant has a binder of cellulose acetate or a cellulose acetate derivative. An example of this type of propellant is described in U.S. Pat. No. 4,570,540, the teachings of which are incorporated herein by reference. These types of LOVA propellants are solvent processed, a process which entails relatively long processing times and a large number of steps. Also, the use of solvent creates environmental problems.

The present invention is directed to LOVA propellants which use thermoplastic elastomers as binders. Thermoplastic elastomers have been previously used in propellants for rocket motors or the like, for example, as described in U.S. Pat. No. 4,361,526 and U.S. patent application Ser. No. 06/925,660 filed Oct. 29, 1986, the teachings of each being incorporated herein by reference. Gun propellants, however, are considered to be a different art than rocket motor propellants. Rocket motor propellants typically contain a particulate metal fuel, e.g., particulate aluminum. Gun propellants, on the other hand, should be substantially free of any metal, and for that matter, should be generally free of any material which leaves a solid residue in the barrel of the gun upon burning. Gun propellants should also be substantially free of chlorine, which degrades the gun barrel.

Furthermore, rocket motor grains are typically formed in a different manner. Gun propellant grains typically take their shape from the extrusion process and must be sufficiently solid when leaving the extruder to retain their extruded shape. Material for rocket motor propellants may be extruded, but generally large rocket motors assume their shape from a mold, e.g., the rocket motor case; thus, after leaving an extruder or mixer, a propellant composition for a rocket motor should be free-flowing or at least moldable so as to be able to assume the shape of the large mold.

SUMMARY OF THE INVENTION

In accordance with the present invention, LOVA gun propellants comprise between about 60 and about 85 wt. percent of high-energy oxidizer particulates and between about 15 and about 40 wt. percent of a binder system which is a plasticized or unplasticized block copolymer having at least one crystalline block and at least one amorphous block, giving the block copolymer thermoplastic elastomeric characteristics.

DETAILED DESCRIPTION OF CERTAIN PREFERRED EMBODIMENTS

LOVA gun propellants comprise between about 60 and about 85 wt. percent of a high-energy oxidizer particulates and between about 15 and about 40 wt. percent of an elastomeric, thermoplastic binder system. The thermoplastic elastomer of the binder system has at least one block which is amorphous at room temperature, e.g., in the range of about 20° C. to about 25° C. and at least one block which is crystalline at room temperature. It is generally necessary that in the block copolymer molecule, there be at least a pair of crystalline blocks flanking an amorphous block, whereby a thermoplastic network may be formed. The crystalline hard blocks preferably melt in a temperature range of between about 70° C. and about 105° C. This temperature range allows processing at temperatures which do not decompose the nitramine fillers. At the same time, in this temperature range, the binder retains good mechanical properties at about 63° C., considered to be the upper use temperature of LOVA gun propellants. The binder system may contain up to about 80 wt. percent of an energetic or non-energetic plasticizer, the plasticizer comprising up to about 35 wt. percent of the LOVA gun propellant composition as a whole.

The two most common oxidizer particulates are tetramethylenetetranitramine (HMX) and trimethylenetrinitramine (RDX). Mixtures of these oxidizers may be used.

Various configurations of thermoplastic elastomers are suitable, including $(AB)_n$ polymers, ABA polymers, and $A_nB$ star polymers, wherein the A blocks are crystalline and B blocks are amorphous at room temperature. In each of these structures, at least two A blocks flank at least one B block, allowing the crystalline A blocks to define a cross-linked structure at lower temperatures, while the amorphous B blocks give the polymer its elastomeric properties.

A wide variety of thermoplastic elastomers may be used in accordance with the present invention, including polyoxetanes, mixed polyesters, polyester-polyethers, and polyamide-polyethers. ABA polymers based upon polyoxetanes and poly(oxetane/tetrahydrofuran) copolymers are described in the above-referenced U.S.

patent application Ser. No. 06/925,660. $(AB)_n$ polymers based upon polyoxetanes and poly(oxetane/tetrahydrofuran) copolymers are described in U.S. patent application No. 07/174,665, filed Mar. 29, 1988, the teachings of which are incorporated herein by reference. Another specific type of thermoplastic elastomers is polyethylene succinate/poly diethyleneglycol adipate (PES/PEDGA) block polymers.

Currently preferred thermoplastic polymers are $(AB)_n$ type polyester-polyether block polymers having short chain crystalline polyester units and long chain amorphous polyether units. Examples of such polymers are:

| Polyester Number | Short Chain Ester Units | Long Chain Ether Units |
|---|---|---|
| 1 | 4GI | PTMEG |
| 2 | 4GI | PEG |
| 3 | 6GT/4GT | PTMEG |
| 4 | 6GT/4GI | PTMEG |
| 5 | 6GT/4GT | PEG |
| 6 | 4GT/4GI | PEG |
| 4GI | 1,4-butylene isophthalate | |
| 4GT | 1,4-butylene terephthalate | |
| 6GI | 1,6-butylene terephthalate | |
| 6GT | 1,6-butylene terephthalate | |
| PTMEG | polytetramethylene ether glycol | |
| PEG | polyethylene ether glycol | |

The plasticizer, if used, may be non-energetic, e.g., dioctyl phthalate (DOP), dioctyl adipate (DOA), Santicizer 8 polyester by Monsanto, butanetriol trinitrate (BTTN), trimethylolethane trinitrate (TMETN), polyglycidal nitrate, or nitroglycerine (NG). Generally, if an energetic plasticizer is used, it is used at a low level in order to maintain the low vulnerability properties of the propellant. Other suitable plasticizers include, but are not limited to dibutoxyethyl phthalate (DBEP), dibutoxyethyl adipate (DBEA), chlorinated paraffin, methyl abietate, methyl dihydro-abietate, n-ethyl-o and p-toluene sulfonamide, polypropylene glycol sebacate, dipropylene glycol dibenzoate, di(2-ethyl-hexyl)phthalate, 2-ethyl-hexyl-diphenyl phosphate, tri(2-ethyl-hexyl) phosphate, di(2-ethyl-hexyl)sebacate, Santicizer 409 polyester by Monsanto, tetra-ethylene glycol-di(2-ethyl hexoate), dibutoxyethoxyethyl adipate (DBEEA), oleamide, dibutoxyethyl azelate (DBEZ), dioctyl azelate (DOZ), dibutoxyethoxyethyl glutarate (DBEEG), dibutoxyethyl glutarate (DBEG), polyethylene glycol 400 dilaurate, polyethylene glycol 400 dioleate, dibutoxyethoxyethyl sebacate, dibutoxyethyl sebacate, and trioctyl trimellitate (TOTM).

The thermoplastic elastomer must be selected so that the filled propellant has a strain (elongation) of at least 1 percent, preferably at least about 3 percent, and preferably less than 10. The modulus must be high enough so that the propellant grain maintains its shape during firing, i.e., so that it does not compress into a blob, and sufficiently low so as not to be brittle. A relatively broad range of moduli are acceptable, i.e., a range of between about 5,000 and about 50,000, preferably below about 35,000.

Propellant compositions are generally required to operate over a wide temperature range and gun propellant grains should be stable at least to a temperature of 165° F. (74° C.). In order for the gun propellants to be used in low temperature environments, it is preferred that the thermoplastic elastomers incorporate soft blocks which retain their amorphous characteristics at low temperatures, i.e., down to −20° C., and preferably, even down to −40° C. Gun propellant grains are generally intended to operate in high pressure ranges, i.e., 30,000 psi or above.

In addition to the binder system and the oxidizer particulates, the LOVA gun propellant composition may contain minor amounts of other materials, such as processing aids, lubricants, colorants, etc.

An important difference between rocket motor propellants and gun propellants is that gun propellants are fired through a barrel which is used multiple times, requiring that the gun propellants be substantially free of materials which would either corrode the barrel or leave deposits in the barrel. Gun propellants are substantially free of metallic particulates and other materials which leave a solid residue. Generally, metal-containing compounds are avoided as these tend to leave deposits; however, metal in compound form may comprise up to about 0.5 wt. percent of the total weight of the propellant composition. For example, potassium sulfate may be incorporated as a flame suppressant. To avoid gun barrel corrosion, corrosive materials or materials which become corrosive upon firing are avoided. Gun propellants should be substantially free of chlorine.

The propellants are processed by blending the ingredients at a temperature of between about 100° C. and 125° C. in a mixer, such as a horizontal sigma blade mixer, planetary vertical mixer or twin screw mixer. The mix is then extruded and cut into a predetermined shape. Extrusion temperatures typically range from about 70° C. to 130° C. A typical shape for a gun propellant is a cylinder having a plurality of axially-directed perforations. In one typical embodiment, the propellant is cylindrical having a perforation running along the cylindrical axis and six additional perforations arranged along a circle halfway between the central perforation and the outside cylindrical wall.

One general feature of thermoplastic elastomers which makes them particularly suitable for LOVA gun propellant applications in their endothermic melting characteristics. The fact that they absorb thermal energy as they begin to melt makes the LOVA gun propellants more capable of withstanding high temperatures.

The invention will now be described in greater detail by way of specific examples.

EXAMPLE 1

Table 1 below summarizes various properties of LOVA gun propellants prepared using different thermoplastic elastomeric binder systems, including mixing conditions, extrusion conditions, mechanical and physical properties and burn rates. In each case, the composition is 78% RDX, 22% binder system. The third composition from the left has a binder system which includes 20% by weight of a non-energetic plasticizer, dioctyl phthalate (DOP). The fourth polymer is of the type reported in above-identified U.S. patent application Ser. No. 06/925,660 as being an ABA block polymer wherein poly(3,3-bis(azidomethyl)oxetane) (BAMO) forms the crystalline A blocks and wherein the B block is a copolymer of poly(3,3-bis(azidomethyloxetane/3-azidomethyl-3-methyloxetane) (BAMO-/AMMO).

TABLE I

| Polymer | PES PDEGA | Polyester #1 (4GI/PTMEG) Santicizer 8 | Polyester #1 (4GI/PTMEG) DOP (4:1) | B-B/A-B |
|---|---|---|---|---|
| Rheocord 40 Test 78% RDX) | LT035 | LT033 | LT051 | LT049 |
| Peak Torque, m-g | 590 | 416 | 1255 | 971 |
| Peak Temperature, °C. | 116° | 114° | 128° | 119° |
| Extrusion (EX87) | 0707-2 | 0629 | 0930-2 | 0921-2 |
| 600 psi Barrel T, °C. | 89° (750 psi) | 95° | 112° | 85° |
| Die T, °C. | 80° | 85° | 99° | 78° |
| DSC (10° C. min, $N_2$) | | | | |
| Tg, °C. | −44° | −54° | −35° | −41° |
| Tm, °C. | +79° | +93° | +120° | +93° |
| 63° C. Slump | | | | |
| Compressibility, % | 2.2 | 19 | 1.9 | 2.2 |
| 60 Min Creep, % | 1.6 | 17 | 0.3 | 1.2 |
| DMA (5° C. Min) | | | | |
| Tg, °C. | −33° | −39° | −64° | −24° |
| E' @ −40° C., MPa | 568 | 508 | 343 | 763 |
| 0° | 224 | 89 | 201 | 315 |
| +20° | 151 | 55 | 162 | 195 |
| +40° | 55 | 9 | 99 | 118 |
| Tensiles @ 25° C. (0.1 in/min) | | | | |
| Modulus, psi | 14,000 | 6000 | 25,300 | 21,000 |
| Stress, psi | 234 | 59 | 460 | 235 |
| Strain, % | 2.2 | 1.1 | 2.0 | 1.3 |
| Burn Rate @ | | | | |
| 11,000 psi, in/sec | 0.85 | 1.10 | 0.76 | 1.88 |
| 26,000 psi, in/sec | 2.89 | 4.09 | 2.09 | 4.82 |

EXAMPLE 2

Table 2 below summarizes properties of LOVA gun propellants prepared from various $(AB)_n$ block polymers having oxetane and tetrahydrofuran (THF) mer units. In each case, BEMO comprises the crystalline blocks. The soft blocks are oxetane polymers, oxetane copolymers, and oxetane/THF copolymers. NMMO is an abbreviation for poly(3-nitratomethyl-3-methyloxetane). BMMO is an abbreviation for poly(3,3-bis(methoxymethyl)oxetane). The $(AB)_n$ polymers are described in above-referenced U.S. patent application Ser. No. 07/174,665.

TABLE II

| Polymer | TPE-1 | ETPE-2 | ETPE-4 | ETPE-5 |
|---|---|---|---|---|
| Soft block | BMMO/THF | BAMO/AMMO | NMMO | BAMO/NMMO |
| Lot No. RBW | III-56 | IV-24 | IV-12 | IV-10 |
| Rheocord Test (78%) RDX | LT026 | LT048 | LT039 | LT037 |
| Peak Torque, m-g | 1358 | 1089 | 780 | 1044 |
| Peak Temperature, °C. | 118° | 120° | 120° | 121° |
| Extrusion (EX87) | 0521 | 0921-1 | 0825-1 | 0810 |
| 600 psi, Barrel T, °C. | 86° | 86° | 94° | 90° |
| Die T, °C. | 79° | 79° | 86° | 84° |
| DSC (10° C./min,$N_2$ | | | | |
| Tg, °C. | −47° | −36° | −25° | −28° |
| Tm, °C. | +69° | +79° | +75° | +76° |
| 63° C. Slump | | | | |
| Compressibility, % | 2.4 | 2.6 | 1.6 | 1.3 |
| 60 Min. Creep, % | 1.0 | 0.5 | 0.6 | 0.5 |
| DMA (5° C./Min) | | | | |
| Tg, °C. | −30° | −21° | −11° | −13° |
| E' @ −40° C., MPa | 553 | 600 | 627 | 613 |
| 0° | 265 | 342 | 440 | 447 |
| +20° | 159 | 214 | 185 | 194 |
| +40° | 64 | 126 | 100 | 97 |
| Tensiles @ 25° C. (0.1 in/min) | | | | |
| Modulus, psi | 29,000 | 31,000 | 29,000 | 24,000 |
| Stress, psi | 261 | 375 | 408 | 461 |
| Strain, psi | 2.3 | 1.6 | 1.9 | 2.0 |
| Burn Rate @ | | | | |
| 11,000 psi, in/sec | 0.83 | 1.10 | 1.06 | 1.12 |
| 26,000 psi, in/sec | 2.33 | 2.96 | 3.02 | 3.12 |
| Drop Wt., Mech. Props. | | | | |
| Strain rate, $sec^{-1}$ | 312 | | 274 | 282 |
| Modulus, GPa | 1.92 | | 2.28 | 3.12 |
| Failure Stress, MPa | 40.7 | | 51.5 | 60.7 |
| Strain, % | 4.26 | | 3.32 | 3.00 |

Thermoplastic elastomers of the $(AB)_n$ type suitable for forming gun propellants in accordance with the present invention may be made from joining hard blocks and soft blocks from the following lists in the manner taught in the above-referenced U.S. patent application No. 07/174,665:

Soft Blocks
poly ethylene glycol (PEG)
polycaprolactone (PCP)
polytetrahydrofuran (PolyTHF)
polypropylene glycol (PPG)
amorphous polyoxetanes
poly(ethylene oxide-tetrahydrofuran)
poly(diethylene glycol adipate)
polyglycidzyl nitrate
polyglycidyl azide (GAP)

Hard Blocks
polyallyl acrylate
polyisobutyl acrylate
poly 1,4-cyclohexylenedimethylene formal, trans
poly 1,2-cyclopropanedimethylene isophthalate
poly decamethylene adipate
poly decamethylene azelaate
poly decamethylene oxalate
poly decamethylene sebacate
polyethylene sebacate
polyethylene succinate
poly hexamethylene sebacate
poly 10-hydroxydecanoic acid
poly tert-butyl-isotactic
poly nonamethylene terephthalate
poly octadecamethylene terephthalate
poly 3,3-bisethoxymethyl (BEMO)
poly pentamethylene terephthalate
poly B-propiolactone
poly tetramethylene p-phenylenediacetate
poly trimethylene oxalate
polyethyl vinyl ether
polypropyl vinyl ether
poly p-xylylene adipate
poly p-xylylene sebacate.

While the invention has been described in terms of certain preferred embodiments, modifications obvious to one with ordinary skill in the art may be made without departing from the scope of the invention.

Various features of the invention are set forth in the following claims.

What is claimed is:

1. A low vulnerability ammunition gun propellant composition comprising from about 60 to 85 wt. percent of particulates of a high-energy oxidizer and between about 15 wt. percent and about 40 wt. percent of a thermoplastic, elastomeric binder system, said binder system being substantially free of metallic particulates and materials which leave a solid residue, said binder system comprising a non-cross-linked, thermoplastic, elastomeric polymer in which at least one pair of crystalline A blocks flanks at least one amorphous B block and from 0 to about 80 wt. percent of a plasticizer, wherein said non-cross-linked, elastomeric polymer comprises crystalline polyester A blocks and an amorphous polyether B block.

2. A propellant composition according to claim 1 which includes a plasticizer which is non-energetic.

3. A propellant composition according to claim 2 wherein said non-energetic plasticizer is dioctyl phthalate.

4. A propellant composition according to claim 1 which includes a plasticizer which is energetic.

5. A propellant composition according to claim 4 wherein said plasticizer is selected from the group consisting of butanetriol trinitrate, trimethylolethane trinitrate and nitroglycerine.

6. A propellant composition according to claim 1 wherein the oxidizer from which said oxidizer particulates are formed is selected from the group consisting of tetramethylenetetranitramine, trimethylenetrinitramine, and mixtures thereof.

7. A propellant composition according to claim 1 wherein said non-cross-linked, thermoplastic, elastomeric polymer comprises crystalline A blocks which are polyesters selected from the group consisting of 1,4-butylene isophthalate, 1,4-butylene terephthalate, 1,6-butylene isophthalate, 1,6-butylene terephthalate and mixtures thereof and amorphous B blocks which are polyethers selected from the group consisting of polytetramethylene ether glycol, polyethylene ether glycol and mixture thereof.

8. A propellant in accordance with claim 1 wherein said propellant is substantially free of chlorine.

9. A propellant in accordance with claim 1 wherein said crystalline A blocks of said non-cross-linked, thermoplastic, elastomeric polymer melt in a temperature range of between about 70° C. and about 105° C.

* * * * *